United States Patent [19]

Ogle et al.

[11] Patent Number: 4,896,386

[45] Date of Patent: Jan. 30, 1990

[54] BEDDING FOUNDATION HAVING SNAP-IN PLACE FORMED WIRE SPRINGS

[75] Inventors: Steven E. Ogle; Richard D. Seneker, both of Carthage, Mo.

[73] Assignee: Leggett & Platt, Incorporated, Carthage, Mo.

[21] Appl. No.: 167,387

[22] Filed: Mar. 14, 1988

[51] Int. Cl.[4] ..... A47C 23/04

[52] U.S. Cl. ..... 5/247; 5/255; 5/267

[58] Field of Search ..... 5/247, 255, 267, 268, 5/272, 273, 276, 277, 476; 267/80, 86, 95, 100, 103–109

[56] References Cited

U.S. PATENT DOCUMENTS

| | | | |
|---|---|---|---|
| 3,825,960 | 7/1974 | Inman et al. . | |
| 3,833,948 | 9/1974 | Surletta et al. . | |
| 3,835,485 | 9/1974 | Klicki . | |
| 3,990,121 | 11/1976 | Whitaker . | |
| 4,101,993 | 7/1978 | Yates et al. | 5/264 B X |
| 4,339,834 | 7/1982 | Mizelle | 5/255 |
| 4,555,097 | 11/1985 | Hiatt | 267/100 |
| 4,704,752 | 11/1987 | Yates et al. . | |
| 4,721,290 | 1/1988 | Hagemeister | 5/247 X |

*Primary Examiner*—Michael F. Trettel

*Attorney, Agent, or Firm*—Wood, Herron & Evans

[57] ABSTRACT

A box spring assembly includes a base frame, a top wire grid and a plurality of formed wire springs interconnecting the top wire grid and the base frame. The formed wire springs each comprises a wire strip formed into an inverted U-shaped configuration with the closed end of each U-shaped spring generally Z-shaped and attached to the top wire grid by a snap-fit connection and the free ends at the bottom of the U-shaped spring being attached to the base frame.

13 Claims, 3 Drawing Sheets

BEDDING FOUNDATION HAVING SNAP-IN PLACE FORMED WIRE SPRINGS

This invention relates to bedding foundations, and more particularly, to a box spring style of bedding foundation.

Box springs or bedding foundations have traditionally included coil springs positioned in a vertical orientation so as to provide resilient support for a bedding mattress. In an effort to improve upon these conventional coil spring types of box spring or bedding foundation assemblies, numerous prior art assemblies have been developed which substitute formed wire springs for the more traditional coil springs. "Formed wire" springs is an art term used to describe springs which derive their resiliency from torsion bars rather than coils. Examples of formed wire springs embodied in box spring assemblies are to be found in U.S. Pat. Nos. 3,825,960; 3,833,948; and 3,835,485. Additionally, some prior art box spring assemblies have been developed which included combinations of coil and formed wire springs, as for example, the box spring assembly shown in U.S. Pat. No. 3,990,121. In those instances wherein formed wire springs and coil springs have been combined in a box spring, the formed wire springs have usually functioned to impart additional firmness to selected areas of the box spring, as for example, around the edge of the box spring or in the center section of the box spring.

Box springs which utilize formed wire springs for imparting resiliency to the product generally include a base frame, an upper wire grid, and a plurality of formed wire springs extending between the base and the wire grid. A characteristic of nearly all such formed wire box springs is that they are relatively expensive and time consuming to assemble. The assembly time and expense is primarily attributable to the attachment of the tops of the springs to the wire grid in such a fashion that the springs will not later work themselves loose from the grid.

It has therefore been an objective of this invention to provide an improved box spring which utilizes a novel formed wire spring and wire grid which may more quickly and less expensively be assembled to create an assembled box spring which is not subject to inadvertent breakage or separation of the springs and the grid.

Still another objective of this invention has been to provide an improved box spring which has all of the resiliency and selective firmness characteristics of prior art box springs, but which may be manufactured and sold substantially less expensively than prior art box springs of the same resiliency and firmness characteristics.

The improved box spring of this invention comprises formed wire springs, each spring of which has a flat, horizontal, Z-shaped top or head section from the opposite ends of which a pair of resilient legs extend vertically downwardly to a base section which is attached to the base frame of the box spring. According to the practice of this invention, the flat, horizontal, Z-shaped heads of the springs are snap-fit and locked into rectangular pockets of the top wire grid so that there is no need for metal clips or other formed connectors for securing the wire springs to the grid. In order to snap-fit and lock the springs within a pocket of the grid, two opposed parallel sides of the flat, horizontal, Z-shaped head of each spring have sections thereof resting beneath a pair of upwardly offset sections f a first pair of opposed parallel grid wires, and opposite ends of a diagonal connecting bar of the Z-shaped head, as well as the adjacent end portions of the parallel sides of the Z-shaped head, extending over the second pair of opposed parallel grid wires which extend perpendicular to the first pair of parallel grid wires. In order to lock the spring within the pocket of the grid, the upwardly offset sections of the first pair of parallel grid wires each have a detent extending downwardly therefrom for a distance greater than the diameter of the wire from which the spring is manufactured. This detent prevents the flat, horizontal, Z-shaped head of the spring from sliding horizontally and inadvertently releasing from the pocket into which it is snap-fit.

The invention of this application provides a box spring which may be assembled substantially less expensively than prior art box springs upon which this invention is an improvement. It also has the advantage of being balanced on opposite sides of the springs because of the vertical spring legs which extend between the Z-shaped head of a formed wire spring and the frame of the box spring being reversed or mirror images of one another. Because of this balanced construction, there is no tendency for the spring to twist upon compression or to pull away from the base supporting frame upon compression of the spring.

These and other objects and advantages of the present invention will be more readily apparent from the following description of the drawings, in which.

Figure 1:
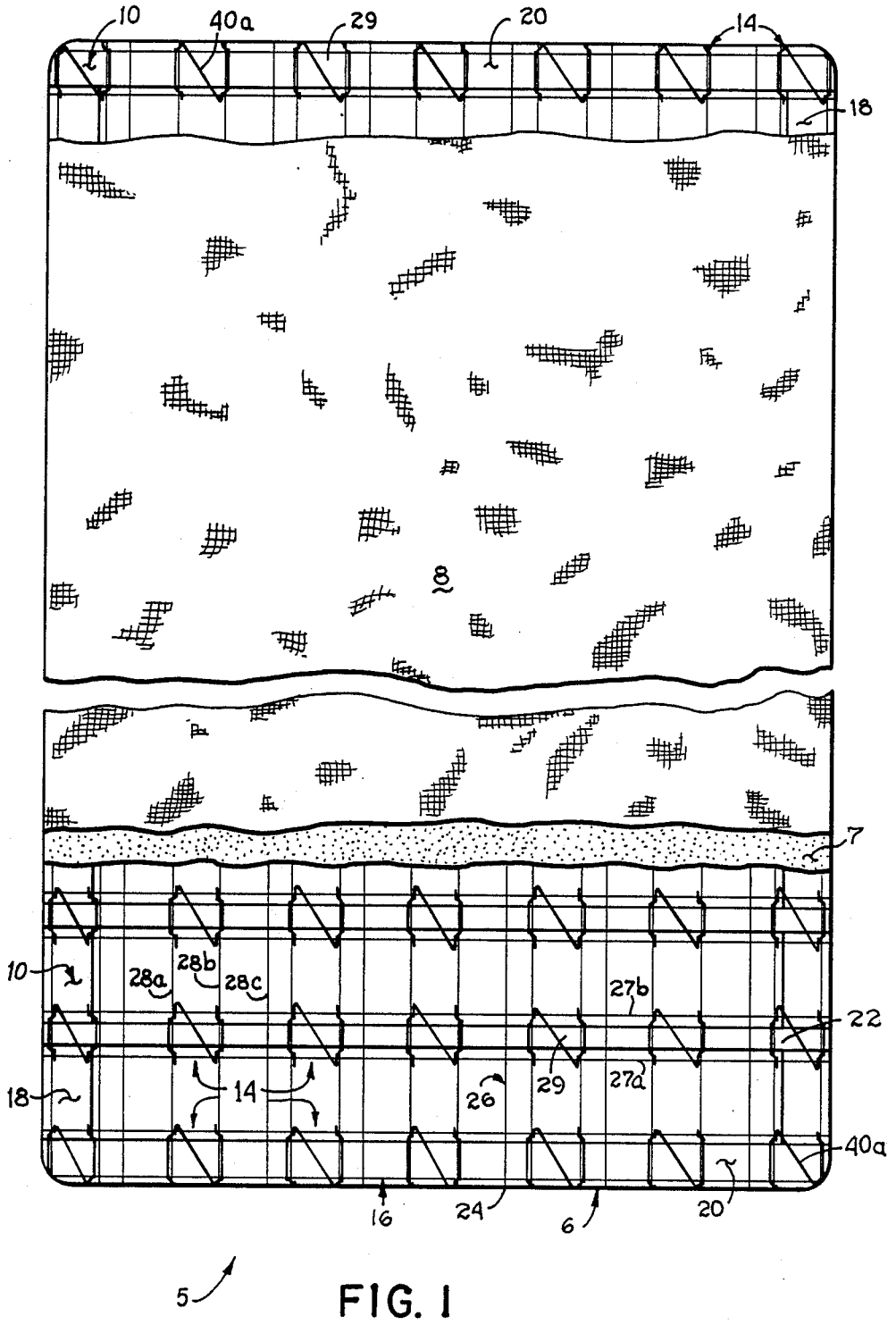
FIG. 1 is a top plan view, partially broken away, of a box spring incorporating the invention of this application.
Figure 2:
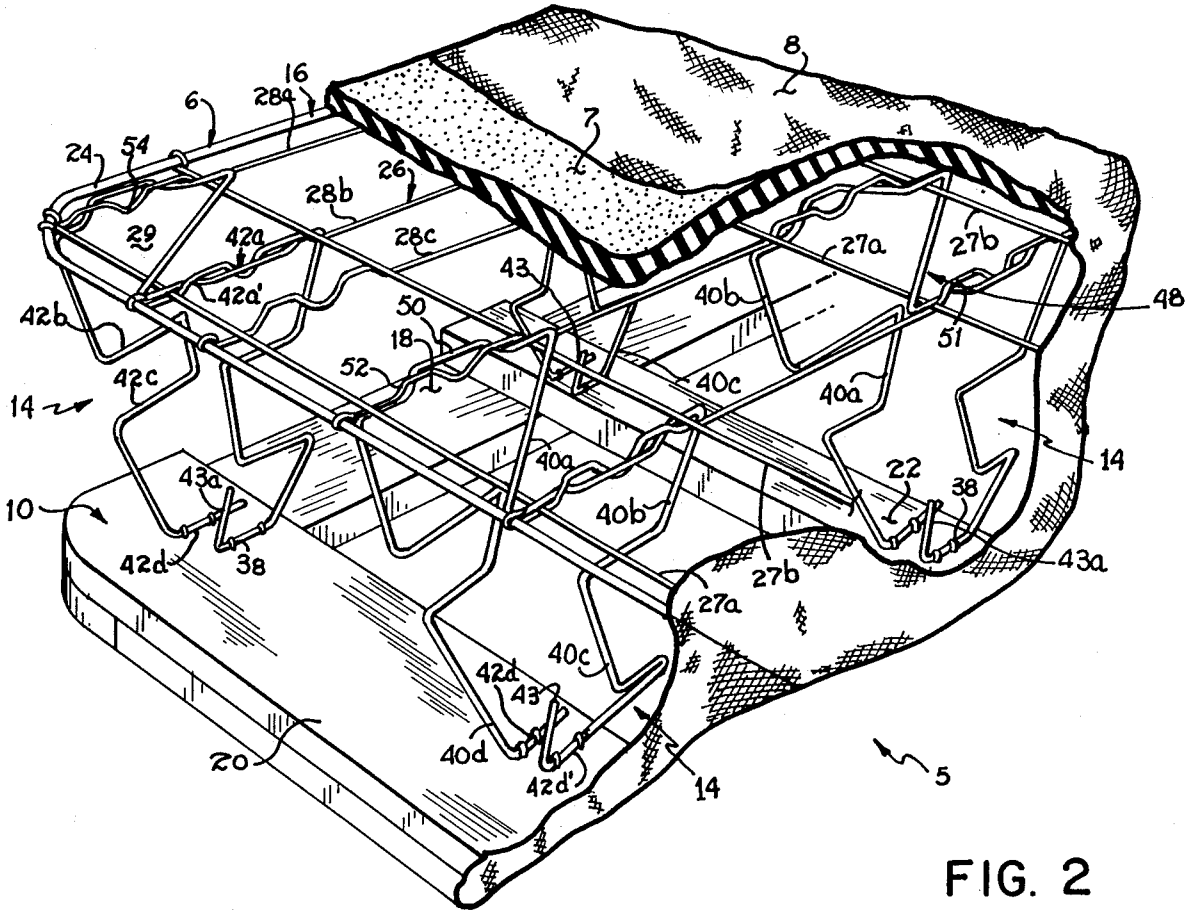
FIG. 2 is a perspective view of one corner portion of the box spring assembly of FIG. 1.

With reference first to FIGS. 1 and 2, it will be seen that the bedding foundation or box spring 5 of this invention includes a box spring assembly 6 over the top of which padding 7 is placed. The box spring assembly 6 and padding 7 are encased in an upholstered covering 8.

The box spring assembly 6 comprises a wooden base frame 10 upon the top of which there is mounted a plurality of formed wire springs 14 for supporting a top wire grid 16. The top wire grid 16 is intended to resiliently support a mattress, as is conventional in the bedding industry.

The base frame 10 is rectangular in configuration and comprises a pair of longitudinally extending side boards 18 (FIG. 2), as well as a pair of transversely extending end boards 20, nailed or otherwise secured to the top of the side boards 18. Additionally, there are a plurality of wooden slats 22 which extend transversely across the rectangular base between the side boards 18. These slats are also nailed or otherwise fixedly secured to the top of the side boards 18.

The top wire grid assembly 16 comprises a border wire 24 and a welded wire grid 26. The border wire 24 is formed into a rectangular configuration and overlies the peripheral edge of the rectangular base frame. The welded wire grid 26 is secured to and located in the plane of the border wire 24, the grid and border wire defining the top plane of the box spring assembly. The welded wire grid 26 comprises a plurality of spaced, transverse wires 27 and a plurality of spaced, longitudinal wires 28. The transverse wires 27 are arranged in pairs 27*a*, 27*b*, and except for intervening reinforcement wires 28*c*, the longitudinal wires 28 are similarly arranged in pairs 28*a*, 28*b*. All of the wires 27 and 28 of the welded wire grid 26 extend between opposite sides and ends, respectively, of the rectangular border wire 24. These grid wires overlie the rows and columns of formed wire springs 14 so as to secure the top of those springs 14 against lateral and longitudinal displacement. The edgemost ones of the transverse wires 27 and longitudinal wires 28 lie in close adjacency and parallel to the border wire so as to provide edge support of the border wire from the springs 14 which are snap-fit into pockets of the wire grid defined by these edgemost wires as explained more fully hereinafter.

The ends of all the grid wires 27, 28 are hooked around the border wire 24 and are preferably welded to the border wire. The intersections or cross-over points of the transverse wires 27 and the longitudinal wires 28 are welded together, thereby providing a matrix of pockets 29 contained within an integral welded wire top grid. In manufacture, the border wire 24 and the welded wire grid 26 are all preformed into a welded top wire grid 16 subassembly.

Figure 3:
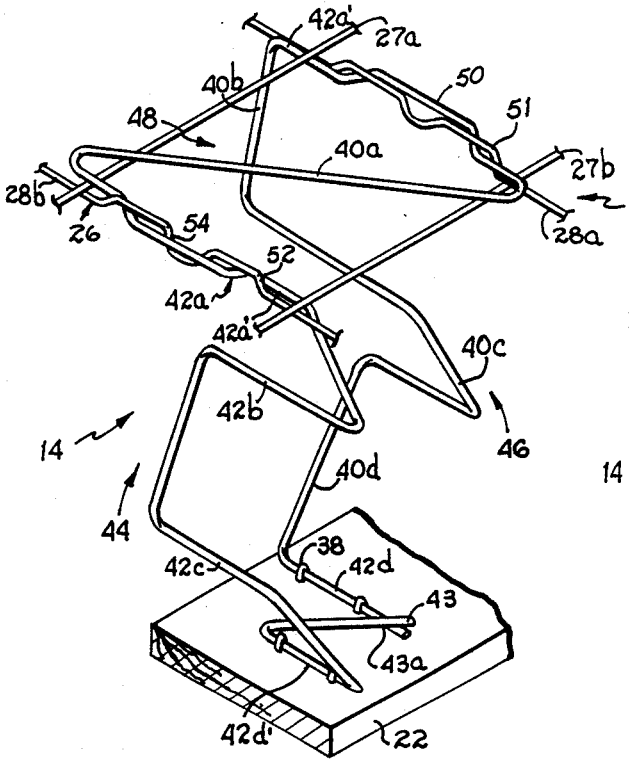
FIG. 3 is an enlarged perspective view of one portion of the spring assembly of FIG. 2.
Figure 5:
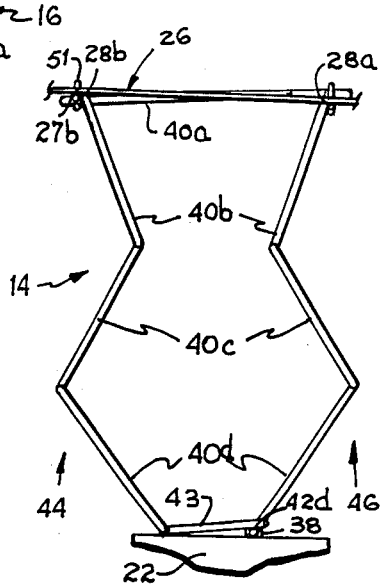
FIG. 5 is an end elevational view of the portion of the box spring assembly illustrated in FIG. 3.

The top wire grid 16, including the four radiused corners, is connected to the wooden frame by the formed wire springs 14. With particular reference to FIGS. 2 and 3, it will be seen that each of these formed wire springs 14 comprises a wire spring strip made from wire bent back and forth upon itself into a generally square, wave-shaped form so as to have connector bar sections 40*a*, 40*b*, 40*c* and 40*d* interconnected by straight torsion bar sections 42*a*, 42*b*, 42*c* and 42*d*. According to the practice of this invention, each of these square, wave-shaped strips is formed into a generally inverted U-shaped configuration having substantially vertical legs 44, 46 interconnected at the top by a substantially flat, Z-shaped top section 48. The substantially flat top section 48 of each spring comprises a diagonal connector bar 40*a* and a pair of torsion bar sections 42*a* extending from the opposite ends of the diagonal connector bar 40*a*. The ends of these two torsion bar sections 42*a* remote from the connector bar 40*a* are connected to the vertical legs 44, 46 of the spring. In the practice of this invention, the torsion bars 42*a* each have an outwardly extending offset 50 formed therein.

Each vertical leg is a mirror image of the other vertical leg 46 of the spring 14. Each leg comprises three connector bars 40*b*, 40*c* and 40*d* interconnected by a pair of straight torsion bar sections 42*b*, 42*c*. The uppermost connector bar 40*b* slopes downwardly and inwardly from the top torsion bar 42*a* to the torsion bar 42*b*. The second connector bar 40*c* slopes downwardly and outwardly from the torsion bar 42*b* to the torsion bar 42*c*, and the bottommost connector bar 40*d* slopes downwardly and inwardly to the lowermost torsion bar 42*d*. The bottommost torsion bar 42*d* is connected to the base frame 10 by staples 38.

In the preferred practice of this invention, the connector bars 40*b*, 40*c* and 40*d* are of substantially the same length and are of lesser length than the diagonal top connector bar 40*a* of the flat top section 48 of the springs 14. In one practice of the invention, the three connector bars 40*b*, 40*c* and 40*d* of the vertical legs 44, 46 of the springs are each approximately 5.0 centimeters in length, and the diagonal connector bar 40*a* of the top section of the springs is approximately 11.5 centimeters in length. The torsion bars 42*b* and 42*c* are approximately 5.0 and 3.5 centimeters in length, respectively. The length of the torsion bars 42*d* are not critical and are approximately 3.0 to 5.0 centimeters in length. The vertical legs 44, 46 of the springs 14 are, in the preferred practice of this invention, each displaced from a vertical plane through the torsion bars 42*a* by approximately 15° . In other words, both legs 44, 46 slope inwardly from the torsion bars 42*a* toward one another such that the torsion bars 42*a* are spaced apart approximately 7.5 centimeters, and the bottom torsion bars 42*d* of each spring 14 are spaced apart by approximately 3.0 centimeters. The springs 14 are approximately 14 centimeters in height.

All of the formed wire springs 14 are attached at the bottom to the end boards 20 or slats 22 of the base frame by staples 38 over the torsion bars 42*d*. Preferably, the free end 43 of one torsion bar 42*d*′ extends inwardly and across the other torsion bar 42*d* and is welded at the intersection 43*a* with the other torsion bar 42*d*.

At the top, all of the springs 14 are attached to the grid 16 by having the substantially flat top sections 48 of the springs snap-fit into pockets 29 of the grid defined by intersecting pairs of transverse wires 27*a*, 27*b* and longitudinal wires 28*a*, 28*b*. To facilitate this snap-fit interconnection of the top sections 48 of the springs 14 within the pockets 29 of the welded wire grid, it will be noted in FIGS. 3 and 4 that the longitudinal wires 28 pass beneath the transverse wires 27 at the intersections thereof. Between the transverse wires 27, the longitudinal wires 28 have upwardly extending, vertical offsets 51 formed therein. These offsets 51 are preferably of approximately the same height as the diameter of the wire from which the springs 14 are formed. The length of the offsets 51 is slightly greater than the width of the portion of the offset portions 50 of the torsion bars 42*a* received beneath the offset 51. As a result of this formation of the offsets 51, the torsion bars 42*a* of the top flat section 48 of the spring 14 is entrapped beneath and between the edges 52 of the vertical offset section 51 of the longitudinal wires 28. To ensure that the substantially flat top section 48 of the springs 14 does not slip out of the pockets 29 of the wire grid within which it is entrapped, the longitudinal wires 28 have a V-shaped indentation 54 formed therein mid-length of the vertical offset 51. This V-shaped indentation 54 extends downwardly from the longitudinal wire 28 in a vertical plane to a depth at least twice, and preferably three times, the diameter of the wire from which the spring 14 is formed.

Figure 4:
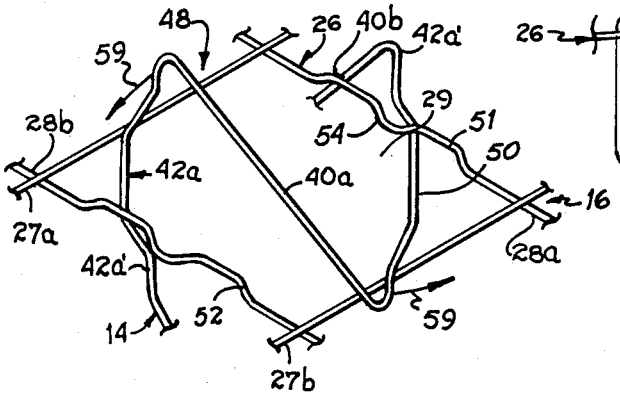
FIG. 4 is a perspective view of a top portion of a formed wire spring and grid pocket illustrating how a top of a formed wire spring is snap-fit into a pocket of a welded wire grid in accordance with the practice of this invention.
Figure 6:
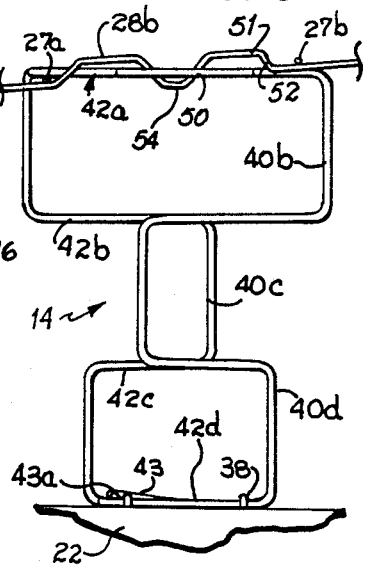
FIG. 6 is a side elevational view of the portion of the box spring assembly illustrated in FIG. 3.

To assemble the springs 14 with the grid 16, the flat top sections 48 of the springs 14 are snap-fit into the pockets 29 of the grid by first locating the top section 48 of a spring beneath the pocket 29 into which it is to be snap-fit with the top diagonal connector bar 40*a* of that top section located over the top and generally perpendicular to the transverse wires 27 of the grid as illustrated in FIG. 4. In this initial (FIG. 4) position of the top section 48 of the spring 14 relative to the pocket 29 into which the spring 14 is to be snap-fit, the top torsion bars 42*a* pass beneath the offset sections 51 of the longitudinal wires 28. To snap-fit the top section 48 of the spring 14 into the pocket 29 of the grid from the position illustrated in FIG. 4, all that is required is to then simply rotate the spring counterclockwise in the direction of the arrows 59 in FIG. 4 until the ends 42*a*′ of the torsion bars 42*a* remote from the connection of the bars 42*a* to the diagonal connector bar 40*a* snap beneath the longitudinal wires 28 of the pocket 29, to the position shown in FIG. 3. As soon as these ends 42*a*′ of the torsion bars 42*a* snap beneath the longitudinal wires 28, the top flat section of the formed wire spring is then fixedly attached to the wire grid. The spring 14 is then locked to the grid as a consequence of this snap-fit interconnection between the wires of the grid and the substantially flat top planar section of the spring.

In practice, the box spring of FIGS. 1–3 is assembled by first nailing the end boards 20 to the tops of the side boards 18 and by nailing the slats 22 to the tops of these same side boards. The preassembled top wire grid 16 having the springs 14 mounted therein is then fitted over the top of the assembled wooden frame so as to position the bottom section torsion bars 42*d* of the formed wire springs 14 atop the base frame. The bottom free end torsion bars 42*d* of the wire springs 14 are then stapled to the tops of the end boards 20 and the ends of the slats 22.

It is important to note that the edgemost longitudinal and transverse grid wires which partially define the pockets 29 for the edgemost springs 14, are located closely adjacent the border wire 24. In practice, these edgemost grid wires extend parallel to the grid wire but are spaced approximately two centimeters from the border wire 24. The need for this close adjacency positioning of the edgemost grid wires derives from the fact that the border wire is made from such heavy gauge or large diameter wire or rod that it is not suitable for snap-fit connection with the edgemost springs 14. By locating the edgemost grid wires in close adjacency, but spaced from, the border wire, the springs 14 may be snap-fit thereto while still providing vertical edge support for the closely spaced border wire. The edgemost grid wires thus act as an inner border wire extending parallel to, but slightly spaced from, the border wire 24, but of much smaller diameter wire suitable for snap-fit connection with the top flat section of the springs 14.

To complete the foundation after completion of the box spring assembly, the fabric pad 7 is overlaid over the top of the welded wire grid and the complete assembly, including the rectangular wooden frame, the springs, the top wire grid, and the fabric pad, are enclosed within the upholstered covering 8.

While we have described only one preferred embodiment of our invention, persons skilled in this art will appreciate changes and modifications which may be made without departing from the spirit of my invention. For example, the relative positioning of the snap-fit formed wire springs in the box spring assembly may be varied without departing from my invention, or those formed wire springs may be mixed with coil springs or other modular springs at selected sites in the assembly. Therefore, we do not intend to be limited except by the scope of the following appended claims.

We claim:

1. A bedding foundation comprising, a bottom, substantially rectangular, horizontal base frame having side and end members and slats extending between said side members, a substantially planar, horizontal, rectangular top wire grid, said grid comprising a border wire and first and second sets of wires, said border wire being of rectangular configuration and surrounding said first and second sets of wires, said first set of wires comprising a plurality of longitudinally extending, spaced, parallel wires and said second set of wires comprising a plurality of transversely extending, spaced, parallel wires, said first and second sets of wires intersecting one another and being fixedly connected to said border wires, pairs of said longitudinally extending wires and pairs of said transversely extending wires defining rectangular pockets for the reception of formed wire springs, a plurality of formed wire springs interconnecting said base frame and said wire grid, each of said formed wire springs comprising a single length of wire of a first diameter, said length of wire being formed into a pair of substantially vertical resilient legs interconnected by a flat, horizontal, Z-shaped section, said flat, horizontal, Z-shaped section of each of said formed wire springs being secured within one of said pockets of said wire grid and the ends of said vertical legs of each of said formed springs remote from said flat, horizontal, Z-shaped section being fixedly secured to said base frame, said flat, horizontal, Z-shaped section of each of said formed wire springs including a pair of parallel torsion bars each connected at one end to opposite ends of a diagonal connector bar and each connected at the opposite end to one of said vertical legs, said flat, horizontal, Z-shaped section being connected to said top wire grid by snap-fit connector means, said snap-fit connector means comprising opposite end portions of said diagonal connector bar of said Z-shaped section being located over opposed wires of one of said first and second sets of wires of said grid and portions of each torsion bar of said pair of torsion bars of said flat, horizontal, Z-shaped section being located beneath an upwardly offset section of one wire of the other of said first and second sets of wires of said grid, said upwardly offset section of said one wire having a downwardly extending depression formed therein for locking said flat, horizontal, U-shaped section of said formed wire spring within said pocket, a fabric pad overlying said top wire grid, and an upholstered covering surrounding said base frame, top wire grid, formed wire springs, and said fabric pad.

2. A bedding foundation assembly comprising, a bottom, substantially rectangular, horizontal base frame having side and end members and slats extending between said side members, a substantially planar, horizontal, rectangular top wire grid, said grid comprising a border wire and first and second sets of wires, said border wire being of rectangular configuration and surrounding said first and second sets of wires, said first set of wires comprising a plurality of longitudinally extending, spaced, parallel wires and said second set of wires comprising a plurality of transversely extending, spaced, parallel wires, said first and second sets of wires intersecting one another and being fixedly connected to said border wires, pairs of said longitudinally extending wires and pairs of said transversely extending wires defining rectangular pockets for the reception of formed wire springs, a plurality of formed wire springs interconnecting said base frame and said wire grid, each of said formed wire springs comprising a single length of wire of a first diameter, said length of wire being formed into a pair of substantially vertical resilient legs interconnected by a flat, horizontal, Z-shaped section, said flat, horizontal, Z-shaped section of each of said formed wire springs being secured within one of said pockets of said wire grid and the ends of said vertical legs of each of said formed springs remote from said flat, horizontal, Z-shaped section being fixedly secured to said base frame, and said flat, horizontal, Z-shaped section of each of said formed wire springs including a pair of parallel torsion bars each connected at one end to opposite ends of a diagonal connector bar and each connected at the opposite end to one of said vertical legs, said flat, horizontal, Z-shaped section being connected to said top wire grid by snap-fit connector means, said snap-fit connector means comprising opposite end portions of said diagonal connector bar of said Z-shaped section being located over opposed wires of one of said first and second sets of wires of said grid and portions of each torsion bar of said pair of torsion bars of said flat, horizontal, Z-shaped section being located beneath an upwardly offset section of one wire of the other of said first and second sets of wires of said grid, said upwardly offset section of said one wire having a downwardly extending depression formed therein for locking said flat, horizontal, Z-shaped section of said formed wire spring within said pocket.

3. The bedding foundation assembly of claim 2 wherein said upwardly offset section of said one wire is offset upwardly from the horizontal plane of said grid by a distance approximately equal to the diameter of the wire from which said formed wire spring is manufactured, and said downwardly extending depression extends downwardly from said offset section for a distance at least equal to said diameter.

4. The bedding foundation assembly of claim 3 wherein said depression extends downwardly from said offset section for a distance at least equal to twice said diameter.

5. The bedding foundation of claim 2 wherein each of said pair of torsion bars of said flat, horizontal, Z-shaped section of said formed wire springs comprises a straight bar having an outwardly extending offset formed therein.

6. The bedding foundation of claim 5 wherein said downwardly extending indentation is located approximately medially of the length of said vertically and upwardly offset section.

7. A bedding foundation assembly comprising a base frame, a top wire grid and a plurality of formed wire springs interconnecting the top wire grid and the base frame, said top wire grid having a plurality of rectangular spring receiving pockets, each of said pockets being formed by two intersecting pairs of wires of said top wire grid, said formed wire springs each comprising a single length of wire formed into a pair of substantially vertical resilient legs interconnected at the top by a flat, horizontal Z-shaped top section, each of said flat, horizontal Z-shaped top sections of said springs being secured within one pocket of said top wire grid, said flat, horizontal, Z-shaped section of each of said formed wire springs including a pair of parallel torsion bars each connected at one end to opposite ends of a diagonal connector bar and each connected at the opposite end to one of said vertical legs, said flat, horizontal, Z-shaped section being connected to said top wire grid by snap-fit connector means, said snap-fit connector means comprising opposite end portions of said diagonal connector bar of said Z-shaped section being located over opposed wires of one of said first and second sets of wires of said grid and portions of each torsion bar of said pair of torsion bars of said flat, horizontal, Z-shaped section being located beneath an upwardly offset section of one wire of the other of said first and second sets of wires of said grid, said upwardly offset section of said one wire having a downwardly extending depression formed therein for locking said flat, horizontal, Z-shaped section of said formed wire spring within said pocket, and each of said vertical resilient legs having lower ends attached to said base frame.

8. The bedding foundation assembly of claim 7 wherein said upwardly offset section of said one wire is offset upwardly from the horizontal plane of said grid by a distance approximately equal to the diameter of the wire from which said formed wire spring is manufactured, and said downwardly extending depression extends downwardly from said offset section for a distance at least equal to said diameter.

9. The bedding foundation assembly of claim 8 wherein said depression extends downwardly from said offset section for a distance at least equal to twice said diameter.

10. The bedding foundation of claim 7 wherein each of said pair of torsion bars of said flat, horizontal, Z-shaped section of said formed wire springs comprises a straight bar having an outwardly extending offset formed therein.

11. The bedding foundation of claim 10 wherein said downwardly extending indentation is located approximately medially of the length of said vertically and upwardly offset section.

12. A formed wire spring for use in a bedding foundation comprising, a single length of wire formed into a pair of substantially vertical resilient legs interconnected by a flat, horizontal, Z-shaped section, said flat, horizontal, Z-shaped section being adapted to be secured within a pocket of a wire grid of a bedding foundation and the ends of said vertical legs of said formed wire spring remote from said flat, horizontal, Z-shaped section being adapted to be fixedly secured to a base frame of the bedding foundation, said flat, horizontal, Z-shaped section of said formed wire spring including a pair of parallel torsion bars each connected at one end to opposite ends of a diagonal connector bar and each connected at the opposite end to one of said vertical legs, said pair of torsion bars of said flat, horizontal, Z-shaped section of said formed wire springs each comprising a pair of spaced, straight, colinear bar sections interconnecting an outwardly extending offset section formed therebetween, each of said vertical legs comprising first, second and third connector bars and first, second and third torsion bars, said first, second and third connector bars being generally horizontal and parallel to one another, said first connector bar extending downwardly and inwardly from one of said pair of torsion bars of said flat, horizontal, Z-shaped section to one end of said first torsion bar, said second connector bar extending downwardly and outwardly from the opposite end of said first torsion bar to one end of the second torsion bar, and said third connector bar extending downwardly and inwardly from the opposite end of said second torsion bar to one end of said third torsion bar, said third torsion bar being adapted to rest upon and be secured to the base frame of the bedding foundation, and one of said third torsion bars having an extension on the opposite end thereof, which extension crosses over and is fixedly connected to the other of the third torsion bars.

13. A formed wire spring for use in a bedding foundation comprising, a single length of wire formed into a pair of substantially vertical resilient legs interconnected by a flat, horizontal, Z-shaped section, said flat, horizontal, Z-shaped section of said formed wire spring including a pair of parallel torsion bars each connected at one end to opposite ends of a diagonal connector bar and each connected at the opposite end to one of said vertical legs, said pair of torsion bars of said flat, horizontal, Z-shaped section of said formed wire springs each comprising a pair of spaced, straight, colinear bar sections interconnected by an outwardly extending offset section formed therebetween, each of said vertical legs comprising first, second and third connector bars and first, second and third torsion bars, said first, second and third connector bars being generally horizontal and parallel to one another, said first connector bar extending downwardly and inwardly from one of said pair of torsion bars of said flat, horizontal, Z-shaped section to one end of said first torsion bar, said second connector bar extending downwardly and outwardly from the opposite end of said first torsion bar to one end of the second torsion bar, and said third connector bar extending downwardly and inwardly from the opposite end of said second torsion bar, and one of said third torsion bars having an extension on the opposite end thereof, which extension crosses over and is fixedly secured to the other of the third torsion bars.

* * * * *